US008610656B2

(12) United States Patent
Ko et al.

(10) Patent No.: US 8,610,656 B2
(45) Date of Patent: Dec. 17, 2013

(54) METHOD FOR GENERATING FRAME-START PULSE SIGNALS INSIDE SOURCE DRIVER CHIP OF LCD DEVICE

(75) Inventors: Man-Jeong Ko, Daejeon-si (KR); An-Young Kim, Daejeon-si (KR); Joon-Ho Na, Daejeon-si (KR); Dae-Seong Kim, Daejeon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 334 days.

(21) Appl. No.: 12/935,164

(22) PCT Filed: Mar. 12, 2009

(86) PCT No.: PCT/KR2009/001223

§ 371 (c)(1),
(2), (4) Date: Sep. 28, 2010

(87) PCT Pub. No.: WO2009/145415

PCT Pub. Date: Dec. 3, 2009

(65) Prior Publication Data

US 2011/0012877 A1 Jan. 20, 2011

(30) Foreign Application Priority Data

Apr. 1, 2008 (KR) ..... 10-2008-0030093

(51) Int. Cl.
*G09G 3/36* (2006.01)

(52) U.S. Cl.
USPC ..... 345/99; 345/98; 345/100

(58) Field of Classification Search
USPC ..... 345/87–103, 690, 204, 211, 212
See application file for complete search history.

(56) References Cited

U.S. PATENT DOCUMENTS

| | | | |
|---|---|---|---|
| 5,828,368 | A | 10/1998 | Jung |
| 6,718,478 | B2 | 4/2004 | Yoon et al. |
| 2004/0017345 | A1 | 1/2004 | Lee |
| 2004/0125061 | A1 | 7/2004 | Furukoshi |
| 2008/0001888 | A1 | 1/2008 | Lee |

FOREIGN PATENT DOCUMENTS

| | | |
|---|---|---|
| CN | 1694143 | 11/2005 |
| JP | 9-198014 | 7/1997 |
| JP | 2003-228338 | 8/2003 |
| JP | 2005-321771 | 11/2005 |
| JP | 2006-78662 | 3/2006 |
| JP | 2007-253694 | 10/2007 |
| TW | 584826 | 1/1992 |

OTHER PUBLICATIONS

International Search Report, Application No. PCT/KR2009/001223, dated Nov. 4, 2009.

*Primary Examiner* — Duc Dinh
(74) *Attorney, Agent, or Firm* — Kile Park Reed & Houtteman PLLC

(57) ABSTRACT

Provided is a method of driving a liquid crystal display apparatus, and more particularly, to a method of generating a frame start pulse signal for instructing driving of a specific function of a source driver in a source driver chip of a liquid crystal display apparatus. Accordingly, by generating a frame start pulse signal for instructing driving of a specific function of a source driver in a source driver chip unlike a conventional method where the frame start pulse signal is externally input, it is possible to reduce the number of input pins for inputting the frame start pulse signal and to remove an input line for inputting the frame start pulse signal in a process of mounting the source driver chip in a printed circuit board.

10 Claims, 3 Drawing Sheets

1) When Reset High Period (t3) > 5CLK, internal GSP signal is generated.

2) When Reset High Period (t3) ≤ 5CLK, internal GSP signal is not generated.

METHOD FOR GENERATING FRAME-START PULSE SIGNALS INSIDE SOURCE DRIVER CHIP OF LCD DEVICE

BACKGROUND OF THE INVENTION

1. Field of the Invention

The present invention relates to a method of driving a liquid crystal display apparatus, and more particularly, to a method of generating a frame start pulse signal for instructing driving of a specific function of a source driver in a source driver chip of a liquid crystal display apparatus.

2. Description of the Related Art

In liquid crystal display (LCD) apparatuses, liquid crystals can transmit light by changing alignment of liquid crystal molecules according to input voltages, so that image data can be displayed.

Recently, among the LCD apparatuses, thin film transistor (TFT) LCD apparatuses have been widely and actively used, which are manufactured by using technologies of manufacturing silicon integrated circuits.

FIG. 1 is a view showing a panel driving system of a general liquid crystal display apparatus.

As shown in FIG. 1, the panel driving system of a liquid crystal display apparatus includes: a panel 30 which is constructed with liquid crystals, color filters, and the like; a gate driving unit 40 which is constructed with gate drivers 41, 42, and 43 for driving them; a source driving unit 20 which is constructed with source drivers 21, 22, and 23 for driving sources of the liquid crystal; and a timing controller 10 which controls the gate driving unit 40 and the source driving unit 20 and outputs pixel data.

Each pixel is constructed with a switch transistor and a liquid crystal device. A gate terminal of the switch transistor is driven by gate drivers 41, 42, 43 . . . . One terminal of the switch transistor except the gate terminal is connected to the liquid crystal device, and the opposite terminal is connected to an output terminal of one of source drivers 21, 22, 23 . . . .

A timing controller 10 controls the entire panel driving system of the liquid crystal display apparatus. The timing controller 10 transmits timing signals CLK, LOAD, and SPi for controlling the gate drivers and the source drivers and video signals R, G, and B to the source drivers 21, 22, 23, . . . .

In general, the timing controller 10 receives the video signals R, G, and B to be transmitted to the source drivers in a low voltage differential signal (LVDS) manner. The timing controller 10 transmits data to the source drivers in a mini low voltage differential signaling (mLVDS) manner.

In a conventional transistor-transistor-logic (TTL) manner used for the timing controller to transmit data to a driver integrated circuit (IC), there are problems of a low transmission rate, high current consumption, a poor electro-magnetic interface (EMI) characteristic. The LVDS manner is to greatly reduce a size of voltage swing of a signal by compensating for the problems of the TTL manner.

In addition, the mLVDS manner is to greatly reduce the current consumption and improve the EMI characteristic of the entire chip by further reducing the size of voltage swing. The data transmission in the LVDS and mLVDS manners are well known to the ordinarily skilled in the art of the liquid crystal display apparatus, and thus, detailed description thereof is omitted.

FIG. 2 is a timing diagram showing recognition of a reset signal in a liquid crystal display apparatus using a conventional mLVDS manner.

In a liquid crystal display apparatus using a conventional mLVDS manner, the reset signal is recognized by the following processes. Firstly, in a state that a load signal LOAD in a high state is input, a signal LV0+,– which are input data signals to be transmitted in the mLVDS manner is maintained in a low state for 200 ns or more (t2). After that, the signals are maintained in a high state for 3 CLKs or more (t3).

Next, the first low signal RST=L of the input data signal LV0+,– triggered at the rising edge of a clock signal CLK+,– is recognized as the reset signal. The timing controller transmits to a source driver a frame start pulse signal for instructing driving of a specific function of the source driver.

In the liquid crystal display apparatus using the conventional mLVDS manner, since the frame start pulse signal required for driving a specific function of the source driver is input from an external timing controller, there is a problem in that input pins for inputting of the frame start pulse signal into the source driver chip are additionally needed, and input lines for inputting the frame start pulse signal are additionally needed in a printed circuit board where the source drivers are mounted.

SUMMARY OF THE INVENTION

The present invention is to provide a method of generating a frame start pulse signal in a source driver chip of a liquid crystal display apparatus of the present invention, by generating a frame start pulse signal for instructing driving of a specific function of a source driver in a source driver chip, so that it is possible to reduce the number of input pins for inputting the frame start pulse signal and to remove an input line for inputting the frame start pulse signal in a process of mounting the source driver chip in a printed circuit board.

According to an aspect of the present invention, there is provided a method of generating a frame start pulse signal for instructing driving of a specific function of a source driver in a source driver chip of a liquid crystal display apparatus, comprising: a load signal activation step of activating a load signal LOAD for designating a starting point of a new reset signal; a reset low maintaining step of maintaining a data input signal LV0 among a plurality of data input signals used to be a reset recognition input signal, in a low state for a predetermined time period; and a reset high maintaining step of maintaining the data input signal LV0 in a high state for three clocks or more after the reset low maintaining step; wherein, if the data input signal LV0 is maintained in the high state for a predetermined clock or more in the reset high maintaining step, the frame start pulse signal is generated in the source driver chip.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention is to remove an input pin and an input line used for inputting a frame start pulse signal by generating the frame start pulse signal for instructing driving of a specific function of a source driver in a source driver chip of a liquid crystal display apparatus.

Hereinafter, embodiments of the present invention will be described in detail with reference to the accompanying drawings.

Figure 3:
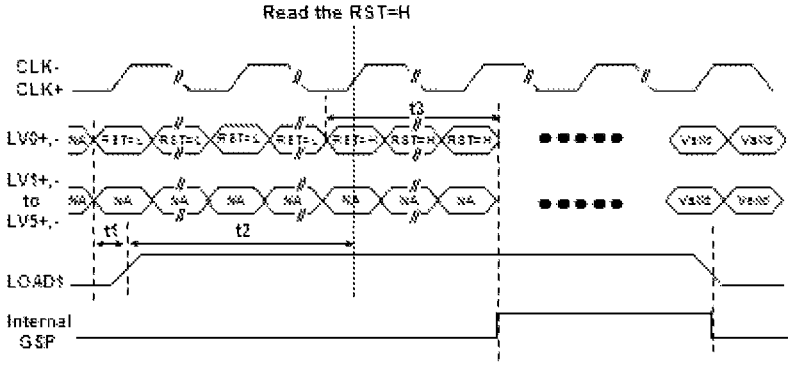
FIG. 3 is a timing diagram for generating a frame start pulse signal according to the present invention.
Figure 3:
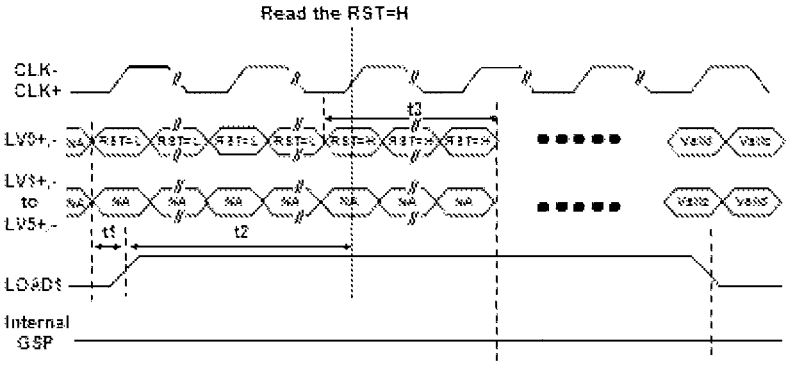

FIG. 3 is a timing diagram for generating a frame start pulse signal according to the present invention.

Figure 1:
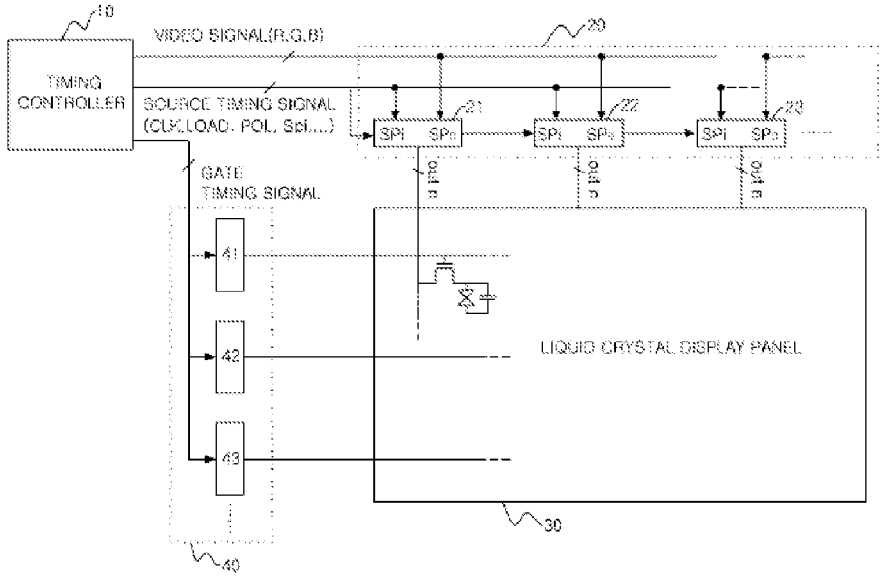
Fig. 1(PRIOR ART)
FIG. 1 is a view showing a panel driving system of a general liquid crystal display apparatus.
Figure 2:
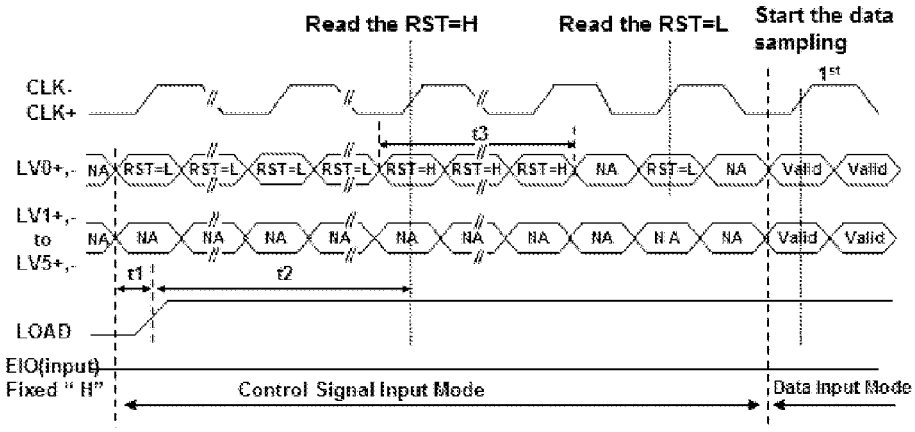
Fig. 2(PRIOR ART)
FIG. 2 is a timing diagram showing recognition of a reset signal in a liquid crystal display apparatus using a conventional mLVDS manner.

As described with reference to FIG. 2, in a state that a load signal LOAD in a high state is input, a signal LV0+,– which are input data signals to be transmitted in the mLVDS manner is maintained in a low state for 200 ns or more (t2). Herein, the load signal LOAD defines a starting point of a new reset signal. After that, the signals are maintained in a high state for three CLKs or more (t3).

Next, according to the present invention, a reset high period (t3) which is maintained for three CLKs or more before input of the first low signal RST=L of the input data signal LV0+,– triggered at the rising edge of a clock signal CLK+,– is used as a delimiting signal for generation of a start pulse signal.

Namely, when a data input signal LV0+,– used as the reset recognition input signal is input, the generation of the start pulse signal is determined by using the reset high period (t3) which is maintained of three CLKs or more before input of the signal "RST=L".

Figure 4:
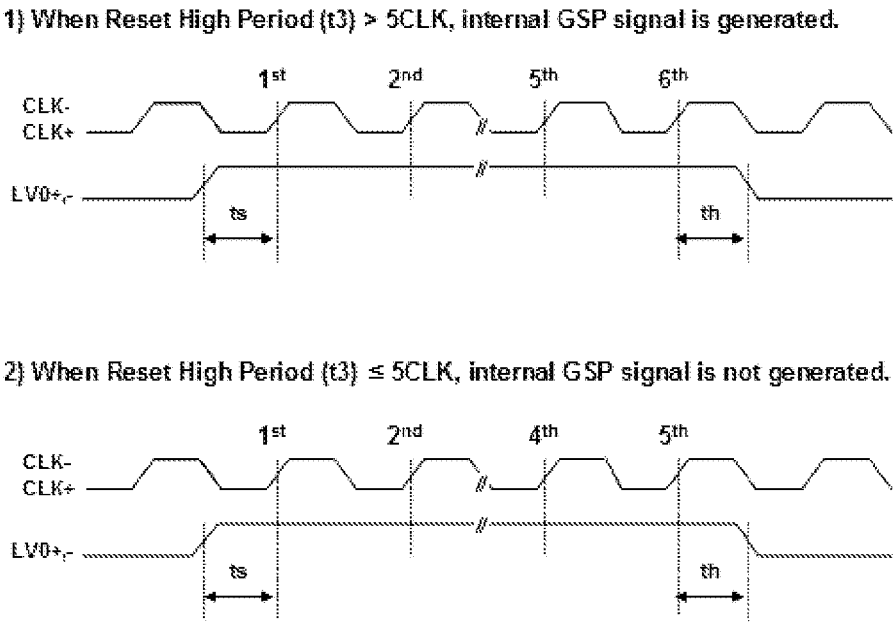
FIG. 4 is a timing diagram showing a method of determining generation of a frame start pulse signal according to an embodiment of the present invention.

FIG. 4 is a timing diagram showing a method of determining generation of a frame start pulse signal according to an embodiment of the present invention.

As shown in FIG. 4, if six "RST=H" or more where the data input signal LV0+,– used as the reset recognition input signal is maintained in the reset high state for 3 CLKs or more are detected at the rising edge of the clock signal CLK+,–, the frame start pulse signal is generated in the source driver chip. If five "RST=H" or less are detected at the rising edge of the clock signal CLK+,–, the frame start pulse signal is not generated.

The embodiment shown in FIG. 4 is an example of a method of generating a frame start pulse signal in a source driver chip. Therefore, various modifications of "RST=H" periods can be used as a delimiting signal for generating the frame start pulse signal in the source driver chip.

Namely, as the period for detecting the "RST=H", a falling edge of the clock signal CLK+,– can be used. In addition, dual edges of the clock signal CLK+,– can be used.

Figure 5:
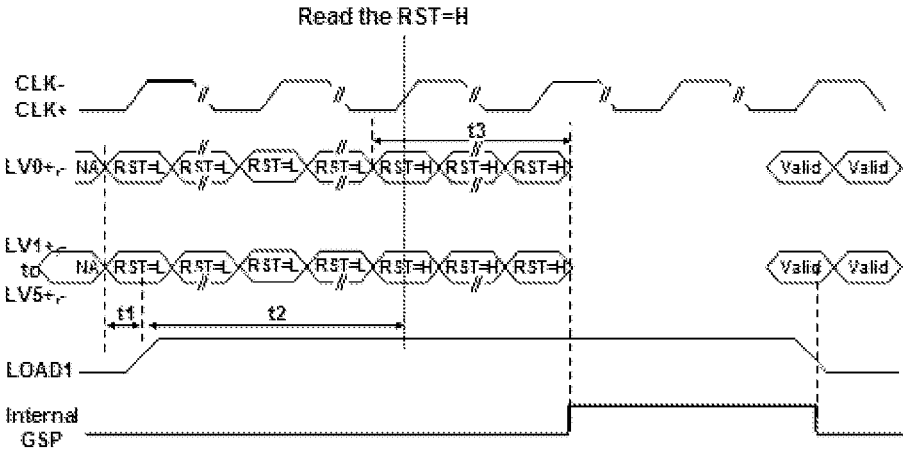
FIG. 5 is a timing diagram for inputting a recognition signal for "RST=H" from an arbitrary data input signal.

FIG. 5 is a timing diagram for inputting a recognition signal for "RST=H" from other data input signal.

According to a method of generating a frame start pulse signal in a source driver chip of a liquid crystal display apparatus of the present invention, it should be noted that, in addition to the signal LV0+,– among a plurality of data input signals, an arbitrary data input signal among other data input signals LV1+,– to LV5+,– can be selected as a delimiting signal of the "RST=H".

TABLE 1

Mini-LVDS bus-line set-Back according to SB signal

| Pin Name | SB = "L" | SB = "H" |
|---|---|---|
| LV0A | LV0+ | LV5– |
| LV0B | LV0– | LV5+ |
| LV1A | LV1+ | LV4– |
| LV1B | LV1– | LV4+ |
| LV2A | LV2+ | LV3– |
| LV2B | LV2– | LV3+ |
| CLKA | CLK+ | CLK– |
| CLKB | CLK– | CLK+ |
| LV3A | LV3+ | LV2– |
| LV3B | LV3– | LV2+ |
| LV4A | LV4+ | LV1– |
| LV4B | LV4– | LV1+ |
| LV5A | LV5+ | LV0– |
| LV5B | LV5– | LV0+ |

Table 1 shows that position and phase of the signal LV0+, that is, a reset recognition input signal is changed according to condition of the SB signal in the mLVDS interface. Referring to Table 1, it can be understood that a plurality of the data input signals LV0 to LV5 used as the reset recognition input signal is inverted to be input.

The reset signal is input as the signal LV0+,– with the phase changed according to the condition of the SB signal as follows. Namely, in case of SB=L, the signal LV0A is input as LV0+, and the signal LV0B is input as LV0–. Therefore, LV0+ is input to the pin LVxA. In case of SB=H, the signal LV5A is input as LV0–, and the signal LV5B is input as LV0+. Therefore, LV0+ is input to the pin LVxB.

In this manner, the input position and phase of the signal LV0+ is changed to be input according to the condition of the SB signal.

In cases of SB=L and SB=H, the input reset signal is as follows. After the rising edge of the load signal LOAD, the signal LV0+ is maintained in the low state Low_0 for 200 ns and, after that, in the high state for three CLKs or more. The signal "RST=L" which is detected at the rising edge of the first-following input clock signal CLK is used as a reset signal.

Namely, in case of SB=H, since the input reset signal is LV5B=LV0+, the phase of the reset signal is inverted to be input in view of the input of the source driver chip.

As described above, in case of SB=H, although the reset signal with an opposite phase may be input to an input pin, the phase is inverted again in the source driver chip. Therefore, the same phase as the case of SB=L can be employed in view of the internal side of the source driver chip.

According to a method of generating a frame start pulse signal in a source driver chip of a liquid crystal display apparatus of the present invention, by generating a frame start pulse signal for instructing driving of a specific function of a source driver in a source driver chip unlike a conventional method where the frame start pulse signal is externally input, it is possible to reduce the number of input pins for inputting the frame start pulse signal and to remove an input line for inputting the frame start pulse signal in a process of mounting the source driver chip in a printed circuit board.

In addition, since signals for processing image data of specific frames or horizontal lines are generated in the source driver chip, it is easy to implement an internal logic.

While the present invention has been shown and described in connection with the exemplary embodiments, it will be apparent to those skilled in the art that modifications and variations can be made without departing from the spirit and scope of the invention as defined by the appended claims.

What is claimed is:

1. A method of generating a frame start pulse signal for instructing driving of a specific function of a source driver in a source driver chip of a liquid crystal display apparatus, comprising:

receiving, by the source driver chip, a clock signal CLK from a timing controller positioned external to the source driver chip;

receiving, by the source driver chip, in a load signal activation step, a load signal LOAD for designating a starting point of a new reset signal;

receiving, by the source driver chip, in a reset low maintaining step, a data input signal LV0 among a plurality of data input signals used to be a reset recognition input signal, in a low state for a predetermined time period;

receiving, by the source driver chip, in a reset high maintaining step, the data input signal LV0 in a high state for three clocks or more after the reset low maintaining step;

determining, by the source driver chip, whether the data input signal LV0 is maintained in the high state for a predetermined clock or more in the reset high maintaining step;

if the source driver chip determines that the data input signal LV0 is maintained in the high state for the predetermined clock or more in the reset high maintaining step, generating, by the source driver chip, the frame start pulse signal in the source driver chip without the source driver chip receiving any frame start pulse signal from the timing controller; and if the source driver chip determines that the data input signal LV0 is maintained in the high state for less than the predetermined clock in the reset high maintaining step, the frame start pulse signal is not generated in the source driver chip.

2. The method according to claim 1, wherein the predetermined clock equals six clocks.

3. The method according to claim 1, wherein the determining whether the data input signal LV0 is maintained in the high state comprises determining, by the source driver chip, using a rising edge or a falling edge of the clock signal CLK whether or not the data input signal LV0 is maintained in the high state for the predetermined clock or more in the reset high maintaining step.

4. The method according to claim 1, wherein the determining whether the data input signal LV0 is maintained in the high state comprises determining, by the source driver chip, using a rising edge and a falling edge of the clock signal CLK whether or not the data input signal LV0 is maintained in the high state for the predetermined clock or more in the reset high maintaining step.

5. The method according to claim 1, wherein the frame start pulse signal is a signal for processing image data of a specific frame or a specific horizontal line of the panel of the liquid crystal display apparatus.

6. The method according to claim 1, wherein a plurality of the data input signals used for the reset recognition input signal is inverted to be input.

7. The method according to claim 2, wherein a plurality of the data input signals used for the reset recognition input signal is inverted to be input.

8. The method according to claim 3, wherein a plurality of the data input signals used for the reset recognition input signal is inverted to be input.

9. The method according to claim 4, wherein a plurality of the data input signals used for the reset recognition input signal is inverted to be input.

10. The method according to claim 5, wherein a plurality of the data input signals used for the reset recognition input signal is inverted to be input.

* * * * *